United States Patent [19]

Berger

[11] 4,406,769

[45] Sep. 27, 1983

[54] ELECTRODE EDGE PROTECTOR, ELECTRODE PROVIDED WITH SUCH PROTECTOR AND ELECTRODEPOSITS AND/OR PRODUCTS OF ELECTROLYSIS MANUFACTURED BY EMPLOYING SUCH ELECTRODES

[76] Inventor: Peter Berger, The Old Vicarage, Gringley-on-the-Hill, Doncaster DN10 4RF, England

[21] Appl. No.: 280,466

[22] Filed: Jul. 6, 1981

[30] Foreign Application Priority Data

Jul. 26, 1980 [GB] United Kingdom ..... 8024541

[51] Int. Cl.[3] ..... C25D 1/00

[52] U.S. Cl. ..... 204/281

[58] Field of Search ..... 204/281, 297 R, 286

[56] References Cited

U.S. PATENT DOCUMENTS

| | | | |
|---|---|---|---|
| 1,977,499 | 10/1934 | Tetrault | 204/281 |
| 2,655,239 | 10/1953 | Kenlock | 52/400 |
| 3,798,151 | 3/1974 | Takamura et al. | 204/281 |
| 3,970,402 | 7/1976 | Yamashita . | |

FOREIGN PATENT DOCUMENTS

| | | |
|---|---|---|
| 746708 | 7/1970 | Belgium . |
| 893070 | 4/1962 | United Kingdom . |

*Primary Examiner*—F. Edmundson

*Attorney, Agent, or Firm*—King and Liles

[57] ABSTRACT

An edge protector 7 for electrodes 1, comprises first and second elongate elements 8, 9, both of superficially electrically insulating material, the first element 8 having a generally "H"-shaped cross-section so as to provide open slots on opposite sides, one slot defined between a pair of outer jaws 12 and the other slot defined between a pair of inner jaws 10, a bare or suitably gasketed edge 6 of an electrode 1 being insertable into and located within the inner jaws 10, and the second element 9 being constituted by a member so dimensioned as to be an interference fit within the outer jaws 12, whereby the outer jaws 12 are forced further apart with the result that the outer jaws 12 endeavour to close the inner jaws 10 to form a seal to prevent electrolyte from wetting the edge 6 of the electrode 1.

14 Claims, 5 Drawing Figures

ELECTRODE EDGE PROTECTOR, ELECTRODE PROVIDED WITH SUCH PROTECTOR AND ELECTRODEPOSITS AND/OR PRODUCTS OF ELECTROLYSIS MANUFACTURED BY EMPLOYING SUCH ELECTRODES

This invention relates to an edge protector for electrodes, e.g. cathode matrix plates as are used in the electrodeposition of metal and, more particularly, in the production of electrodeposits upon, and their subsequent integral detachment from, so-called master-cathodes or matrices in the form of flat plates or sheets, as practised in such processes as electroforming, electrolytic extraction ("electrowinning") and refining of metals.

Though by no means confined thereto, the invention is especially relevant to the production of so-called "starting sheets" in electrowinning and electro-refining of such metals as copper, zinc, nickel and cobalt. Thus, for example, a copper starting sheet serves as the cathode in the production of electrolytic copper, forming the nucleus of the electrodeposited end-product. This starting sheet is itself produced by electro-deposition onto a matrix plate from which it is detached; the matrix is then re-used again and again, for as many cycle as possible. If made of titanium (as often is the case), the matrix is expensive so that it is important to avoid its being damaged during the stripping of the electrodeposited starting sheet. For economic reasons, the stripping process needs to be carried out quickly, so as to speed the recycling of the matrices. When the electrodeposit is not readily detachable, the process is slowed down, at best, but may result in large numbers of starting sheets being torn or deformed—and, at worst, the valuable matrix may itself be damaged and rendered unserviceable in the stripping process.

A typical matrix plate may be 3 mm/⅛" thick, measuring (in its immersed portion) some 40"×40" (ca. 1 m×1 m) so that each side produces a starting sheet of some 11 ft.$^2$ (ca. 1 m$^2$) in area. It will be seen, therefore, that the stripping process is rendered more difficult when the electrodeposit extends over the vertical edges of the matrix plate, so that a continuous layer surrounds the matrix in the horizontal plane; the bottom edge creates no such problems by itself, if the vertical edges are kept bare, the deposit joining back and front layers across the horizontal bottom edge is simply trimmed off to produce the two separate starting sheets; it is usual practice to provide a 'V'-notched groove along the 3 mm wide downward facing base of the matrix plate, and to operate with anodes which are significantly shorter in length than the (matrix) cathodes. The electrodeposit reaching the apex of the inverted 'V'-notch is, therefore, extremely thin and readily fractures in a straight line along the apex of the groove when the deposited starting sheets on front and back of the matrix plate are stripped therefrom and folded away from the plate, using the apex-line of the groove as the folding axis. Protection of the grooved base of the matrix plate is required only in special cases (e.g. when there would be adhesion of the deposit within the groove in processes using other than inherently superficially "passive" matrix plates—i.e., other than, e.g. titanium).

A number of so-called "edge protectors" have been proposed to prevent metal deposition at the vertical edges of the matrix plate; but none of these devices has remained effective for more than but a relatively few cycles, and partial break-down of such a protector can create additional hazards of damage to electrodeposit and/or matrix during the stripping process. Moreover, waste material from "lace" edges of the deposit requires re-melting which is wasteful of energy and inconvenient. Conventional "stop-off" coatings are porous (especially at the relatively sharp edge of the titanium plate, where such dipped or painted coatings are thinnest), and if thickly applied, their adhesion is inadequate. Rubber and/or plastic "edge-strips" are hitherto proposed all relay upon the intrinsic elasticity or "springiness" of the material to provide an effective seal onto the matrix plate to prevent the electrolyte from penetrating; these edge-strips are of "U" profile, resembling edge-trim on a motor-car door surround etc; one type proposed is made up of twin 'U' sections, a soft inner one (presumably to overcome surface irregularities on the rolled titanium sheet) with a stiff outer 'U' intended to act as a clamp to ensure sealing; in all these cases, the effect of the electrolyte temperature of some 60° C. or more, and applied over prolonged periods has resulted in break-down; the materials used softened and/or their elasticity was progressively reduced, and this, added to the considerable differential in the respective coefficients of thermal expansion of the plastic and the titanium, resulted in break-down of the seal. The electrolyte is very searching, and metal "seeds" are deposited wherever seepage occurs; these seeds grow apace, and total break-down of the edge-insulation becomes inevitable. Moreover, there was the added hazard of the operator's knife slipping during the stripping process, dislodging the edge-strip. This hazard is a drawback also when adhesive tape is used for edge-insulation. The adhesive also loses its efficiency, but there are reports that polyester-based adhesive tape can remain effective for some 20–30 cycles. In large operations, however, it would not be economical to re-apply adhesive tape after only 20–30 cycles. Edge protection is especially important in processes such as the recently developed "ISA Process" (described at the 110th A.I.M.E. Annual Meeting in Chicago, Ill., U.S.A. on Feb. 23, 1981) where starting sheets are dispensed with, and detachable thick copper cathodes (weighing 45 kg each, 90 kg per pair) are deposited onto nickel-plated stainless steel matrices. Here, vertical edge-strips of extruded "Cycoloy 800" plastic are fixed to the matrices by means of plastic pins passing through holes drilled in the matrix, and sealing is effected by means of a sacrificial layer of high melting point wax, which is also applied to the base of the matrix plate: this waxing process is carried out for each electrodeposition cycle, the process is laborious and requires special machines both for the application and the recovery of the wax. (Ref.: "The use of permanent stainless steel cathodes at Copper Refineries Pty. Ltd., Townsville" by I. J. Perry, J. C. Jenkins and Y. Okamoto: Trans.AIME Conference Feb. 23, 1981, Chicago, Ill.)

According to the present invention an edge protector for electrodes, comprises first and second elongate elements, both elements being of superficially electrically insulating material, the first element having a generally 'H'-shaped cross-section so as to provide open slots on opposite sides, one slot defined between a pair of outer jaws and the other slot defined between a pair of inner jaws, a bare or suitably gasketed edge of an electrode being insertable into and located within the inner jaws, and the second element being constituted by a member so dimensioned as to be an interference fit with the outer jaws whereby the outer jaws are forced further apart with the result that the outer jaws endeavour to close the inner jaws which are levered towards one another, thereby to exert pressure upon the surface of the electrode, either directly or through any gasket, located within the inner jaws to form a seal to prevent electrolyte from wetting the edge of the electrode located within the inner jaws.

Thus, the edge protector of the present invention, unlike the aforementioned prior art proposals operates without recourse to the "springiness" of its material of construction, nor to the use of adhesives or painted-on layers—other than for the purpose of compensating for surface irregularities as in the manner of a gasket—and its efficiency is unimpaired by the effects of thermal expansion; a number of materials which need not be identical for both elements may be utilised for its construction, and the type selected must, of course, remain unaffected chemically and thermally, by the process environment. The principle of operation is simple leverage which not only produces but sustains the necessary forces to maintain efficiency and resistance to dislocation, thus overcoming the shortcomings of existing devices as described in the foregoing.

One or both elongate elements of the edge protector may be made wholly of electrically insulating material, or may be enshrouded in electrically insulating material, e.g. by being made principally of metal with a central, metal core. The two elongate elements of the edge protector may be of substantially equal length as appropriate for the size of the electrode concerned, and made of suitable rigid insulating material, e.g. polypropylene, e.g. by injection moulding. Alternatively, the second element may comprise a multiplicity of elongate pieces, the sum total of their combined lengths being substantially equal to the length of the first element of the edge protector. The second element may be of polygonal, circular or oval cross-section; and its total effective length may be made up from more than one piece interspaced at not more than 5 mm when assembled within the outer jaws of the first element. A rubber mallet may be used to force the second element into the outer jaws, these being shaped so as to retain the second element securely within the outer jaws. Furthermore, the second element may be of a material having a greater coefficient of thermal expansion than the material of the first element whereby the leverage action on the inner jaws is enhanced, if as is often the case, the electrode matrix is, in use, employed at elevated temperatures.

The invention also includes an electrode, of either polarity, provided with edge protectors as defined above, e.g. a cathode matrix plate or an insoluble anode.

The invention further includes electrodeposits and/or products of electrolysis manufactured by employing electrodes are defined above.

In detail, the inner jaws may be so proportioned as to accept the edge of the electrode, inserted therein to a depth of (say) 8–10 mm, the gap-width being just adequate to accommodate the thickness of the electrode, a so-called friction fit. Where the electrode's "as rolled" surface has irregularities, the edge may, with advantage, be gasketed, e.g. by a suitable adhesive tape, such as polyester tape with thermosetting adhesive, applied to the portion of the electrode at and adjacent to the edge which is to be subsequently inserted into the inner jaws. It will be realised that the said "H" configuration is in effect two "levers" (viz., the verticals of the 'H'), with the fulcrum-plane represented by the horizontal crossbar of the 'H'.

It is a further advantage that this edge protector—by itself, or serving as a structural support for attachment of supplementary devices—may be utilised to facilitate precise location of an electrode in the form of a cathode within the cell and/or relative to the anode, both in precision plating processes and for the purpose of preventing accidental short-circuits. Moreover, the edge protector may also be utilised with (insoluble) anode-plates, providing a convenient support for the attachment of e.g. anode-shields, bipolar or auxiliary electrodes etec. Although primarily intended for use attached to the vertical immersed edge of cathode matrix plate, the edge protector is equally suitable for attachment to the plate's horizontal bottom edge when this is required. The two elongate elements of the edge protector may have such longitudinal dimensions as to protrude beyond the immersed length or breadth of the electrode to which edge protectors are fitted. A piece of compressible and elastic or springy material such as nitrile "rubber" or neoprene ca. 3.5 mm thick and some 9 mm square may be entrapped within the protruding inner jaws so as to be in close contact with the 3 mm/$\frac{1}{8}$" wide bare or taped bottom edge of the electrode within the inner jaws to prevent metal deposition on that portion (if bare) or to maintain close adhesion thereto of tape, if tape is employed as aforesaid. The said protrusions may serve for the additional purposes of locating an electrode plate in a cell and/or maintaining inter electrode distance therein and/or act as structural supports serving the said and/or other purposes, and the said protrusions also protect the bottom edge of the electrode plate when this has to be stood upright on the floor outside the cell during repairs or maintenance to equipment such as conveyors etc. The protruding ends of these vertical edge protectors of an electrode plate may also be interconnected by means of a member passing below the horizontal base of the plate. The said connecting member may be so designed and constructed as to serve any of the additional purposes as already referred to, and/or to protect the plate's horizontal bottom edge or (merely) its downward-facing base. Depending upon the intended purpose of the said member, it may be attached to the vertical protrusions by means of permanent fixture, or it may be hinged at one end and detachably fastened at the other end, or it may be attached in such a manner as to be readily detachable from the vertical protrusions when required. Fixing methods—depending upon the member's shape in profile, etc.—include, e.g. mitred joints which may be welded, or gussetted and pinned or bolted, or clamping the ends of the said member within the inner jaws of the protrusions of the vertical edge protectors. In those special cases (usually confined to electroforming and/or precision plating) where it is necessary to protect all four edges of a plate, the latter may be inserted into a "U" frame formed of two vertical and one horizontal edge protector as hereinbefore described, with mitred and welded joins at the corners of the base of the 'U'. A fourth edge protector is clamped onto the top edge of the plate—usually allowing a gap for attachment of the electrical conductor thereto. The said protrusions of vertical edge protectors fitted to an electrode plate may thus readily be used in a number of different ways to provide anchor-points for attachment of protectors of one or both horizontal edges of the plate.

The invention will now be described in greater detail, by way of example, with reference to the accompanying drawings, in which.

Figure 3:
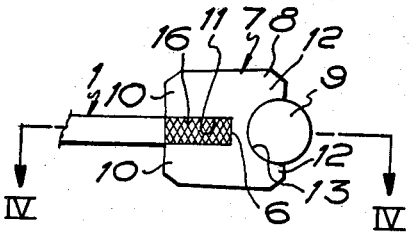
FIG. 3 is an enlarged view in the direction of arrow III of FIG. 1.
Figure 5:
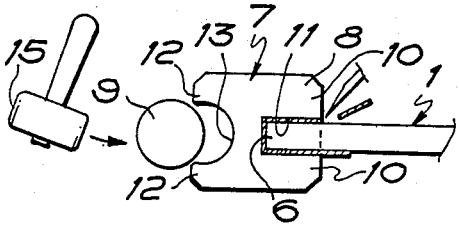

FIG. 5 corresponds to FIG. 3 but illustrates the manner of assembly.

In the drawings, a cathode matrix plate 1 is illustrated immersed in electrolyte the surface of which is indicated at 2, the plate 1 being generally rectangular and provided, at an upper edge 3 above the electrode surface 2 with a plurality of electrical conductors 4 leading to an electrode bar (not shown) of the cell. The plate 1 also has a horizontal bottom edge 5 and opposed vertical edges 6.

Figure 1:
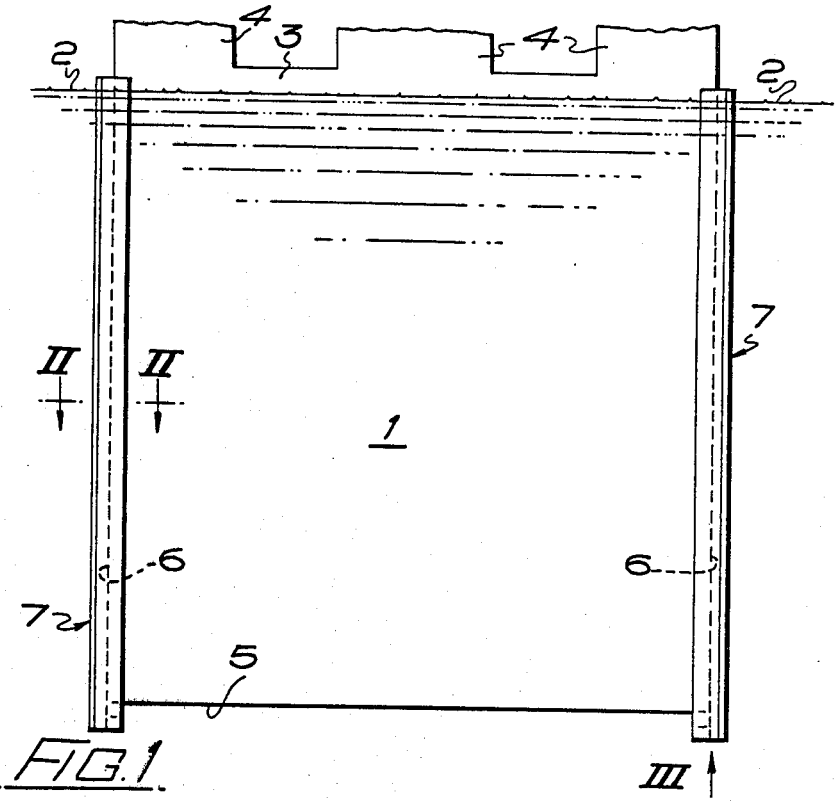
FIG. 1 is a side elevation of an electrode in accordance with one aspect of the invention provided with edge protectors in accordance with another aspect of the invention and immersed in a cell.
Figure 2:
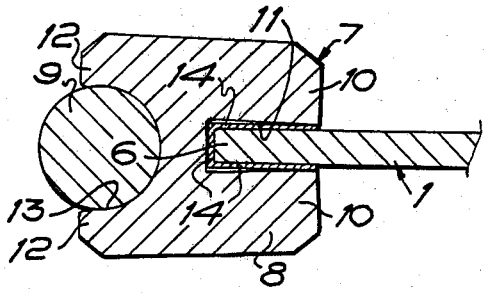
FIG. 2 is an enlarged section on the line II—II of FIG. 1.

As can be seen from FIG. 1, each vertical edge 6 is provided with an edge protector 7 which extends from above the electrolyte surface 2, to below the bottom edge 5. Considering FIG. 2, each edge protector 7 can be seen to comprise a first elongate element 8 and a second elongate element 9, both of electrically insulating material, e.g. polypropylene. The first element 8 is "H"-shaped to provide a pair of inner jaws 10 defining a generally parallel sided slot 11 and a pair of outer jaws 12 defining a generally semi-circular slot 13. As will be apparent to those skilled in the art, the profile of semicircular slot 13 is slightly greater than a semicircle. Further, as readily appreciated from the drawings in FIG. 2 in particular, the diameter of the second element 9 is at least 30% greater than the nominal width of the slot 11. Before insertion into the slot 11, the edges 6 of the matrix plate 1 are provided with a gasket 14 of polyester tape having a thermosetting adhesive to counter any surface irregularities in the edge 6, the slot 11 being of such a width that the edge 6 and its gasket 14 may be pressed as an interference fit into the slot 11 and be retained there by friction, and this situation has been attained in FIG. 5. The second element 9 is of circular section and as indicated in FIG. 5, is positioned over the slot 13 and tapped into its fully engaged position shown in FIG. 2 by a rubber mallet 15 or similar tool. The effect of inserting the second element 9 is to force the outer jaws 12 further apart with the result that the inner jaws 10 are levered towards one another thereby exerting greater pressure upon the gasket 14, so that in service, an effective seal is formed by the inner jaws 10, to prevent electrolyte from wetting the edges 6. Although the first element 8 is one piece, the second element can consist of a plurality of individual pieces.

Figure 4:
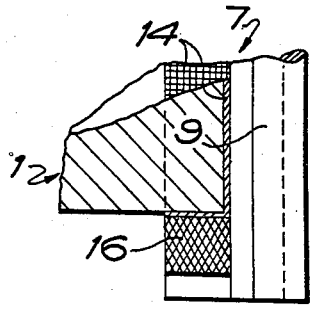
FIG. 4 is a part section on the line IV—IV of FIG. 3.

FIG. 4 details the protrusion of an edge protector 7 below the bottom edge 5, the protrusions serving, e.g. as legs and/or for location purposes of the matrix plate 1 within a cell and/or to protect the bottom edge 5 when the matrix plate is stood upright after removal from a cell. The protrusions are provided with a piece of nitrile rubber 16 secured between the inner jaws 10, to maintain adhesion of the tape 14 to the base of the matrix plate 1.

What I claim is:

1. An edge protector for an electrode, said edge protector comprising first and second elongate elements, both said elements being made of a rigid material which is firstly electrically insulating and secondly is chemically and thermally stable in the intended process environment of said electrode, said first element having a generally 'H'-shaped cross-section so as to define open slots on opposite sides thereof, one said slot profiled generally as a circular segment greater than a semicircle and defined between a pair of outer jaws and the other said slot defined between a pair of inner jaws, with an edge of an electrode being insertable into and located within said inner jaws, and said second element being constituted by a member of circular cross-section dimensioned and shaped for interference snap fitting engagement with said outer jaws whereby said outer jaws are forced further apart with the result that said outer jaws endeavor to close said inner jaws which are levered towards one another, thereby to exert a substantially uniform pressure upon said surface of said electrode when located within said inner jaws to form a seal to prevent electrolyte from wetting said edge of said electrode located within said inner jaws.

2. An edge protector as claimed in claim 1, wherein said two elongate elements of the said edge protector are of subtantially equal length and made of one single piece of stable insulating material.

3. An edge protector as claimed in claim 1, wherein the insulating material is polypropylene.

4. An electrode provided with at least one edge protector as defined in claim 1.

5. A cathodic electrode provided with at least one edge protector as defined in claim 1.

6. An anodic electrode provided with at least one edge protector as defined in claim 1.

7. A cathodic matrix plate provided with at least one edge protector as defined in claim 1.

8. An electrode as claimed in claim 4, wherein edges of said electrode intended to receive said edge protectors are enveloped with an adhesive gasketing film.

9. An electrode as claimed in claim 8, wherein said adhesive film is a polyester tape with thermosetting adhesive.

10. An electrode as claimed in claim 4, provided with said edge protectors along edges which, at least in use, will be vertical, and also along a horizontal edge.

11. An electrode as claimed in claim 10, wherein at least one of said edge protectors has such longitudinal dimensions as to protrude beyond the breadth or length respectively of said electrode.

12. Electrodeposits and/or products of electrolysis manufactured by employing electrodes as defined in claim 4.

13. An edge protector as recited in claim 1, wherein said circular cross-section of said second element has a nominal diameter which is at least 30% greater than the nominal slot-width between the inner jaws of said first element.

14. An electrode as recited in claim 11 wherein a piece of suitable compressible and springy insulating material is entrapped within said protruding inner jaws so as to be in close contact with that portion of said electrode which lies within said inner jaws and in a plane normal thereto at which said protrusion commences.

* * * * *